US008295746B2

(12) United States Patent
Matsumoto

(10) Patent No.: US 8,295,746 B2
(45) Date of Patent: Oct. 23, 2012

(54) IMAGE FORMING APPARATUS INCLUDING A SECONDARY TRANSFER UNIT AND A SHEET GUIDING MEMBER

(75) Inventor: Shogo Matsumoto, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 649 days.

(21) Appl. No.: 12/338,070

(22) Filed: Dec. 18, 2008

(65) Prior Publication Data

US 2009/0208257 A1 Aug. 20, 2009

(30) Foreign Application Priority Data

Feb. 19, 2008 (JP) ..... 2008-037303

(51) Int. Cl.
*G03G 15/01* (2006.01)
*G03G 15/16* (2006.01)

(52) U.S. Cl. ..... 399/302; 399/316

(58) Field of Classification Search ..... 399/302, 399/308, 316
See application file for complete search history.

(56) References Cited

U.S. PATENT DOCUMENTS

| | | | | |
|---|---|---|---|---|
| 7,664,445 | B2 * | 2/2010 | Nishida et al. | 399/316 |
| 7,706,734 | B2 * | 4/2010 | Higashimura et al. | 399/316 |
| 2007/0280750 | A1 * | 12/2007 | Kurosu et al. | 399/316 |

FOREIGN PATENT DOCUMENTS

| | | |
|---|---|---|
| JP | 2003-122142 | 4/2003 |
| JP | 3813378 | 6/2006 |
| JP | 2008-3445 | 1/2008 |
| JP | 2008-9034 | 1/2008 |

OTHER PUBLICATIONS

Japanese Office Action issued Jun. 5, 2012, in Japan Patent Application No. 2008-037303.

* cited by examiner

*Primary Examiner* — David Gray
*Assistant Examiner* — Gregory H Curran
(74) *Attorney, Agent, or Firm* — Oblon, Spivak, McClelland, Maier & Neustadt, L.L.P.

(57) ABSTRACT

One end of a sheet guiding member on a transfer nip side is located on a straight line connecting an exit of a registration nip formed between a pair of registration rollers and an entrance of the transfer nip or on an opposite side of an intermediate transfer belt across the straight line and on one side of a triangle formed by connecting rotation centers of the transfer member, the transfer roller, and the transfer guide roller or inside the triangle.

11 Claims, 4 Drawing Sheets

IMAGE FORMING APPARATUS INCLUDING A SECONDARY TRANSFER UNIT AND A SHEET GUIDING MEMBER

CROSS-REFERENCE TO RELATED APPLICATIONS

The present application claims priority to and incorporates by reference the entire contents of Japanese priority document 2008-037303 filed in Japan on Feb. 19, 2008.

BACKGROUND OF THE INVENTION

1. Field of the Invention

The present invention relates to an electrophotographic image forming apparatus, and more particularly, to an image forming apparatus including an intermediate transfer belt.

2. Description of the Related Art

A typical electrophotographic image forming apparatuses employs an intermediate transfer method. In the intermediate transfer method, a toner image formed on an image carrier, such as a photosensitive element, is primary-transferred onto an intermediate transfer medium, and the toner image transferred onto the intermediate transfer medium is secondary-transferred onto a recording medium. As the intermediate transfer medium, a belt-like intermediate transfer medium is the mainstream. For example, Japanese Patent No. 3813378 discloses an image forming apparatus including such a belt-like intermediate transfer medium.

The image forming apparatus disclosed in Japanese Patent No. 3813378 includes an endless belt-like image carrier, a transfer site, a recording-medium conveying guide, a transfer unit, and a pressing member. The endless belt-like image carrier is supported by a plurality of supporting rollers, and rotates endlessly thereby carrying a toner image formed thereon. The transfer site is provided at an arbitrary position around the endless belt-like image carrier. The recording-medium conveying guide is arranged on the upstream of the transfer site in a rotating direction of the endless belt-like image carrier, and guides a recording medium to be conveyed toward the endless belt-like image carrier. When the recording medium guided by the recording-medium conveying guide is conveyed to the transfer site, the transfer unit is in contact with a rear surface of the recording medium. The transfer unit applies a transfer voltage of a polarity opposite to that of the toner image to the recording medium, whereby the toner image formed on the endless belt-like image carrier is transferred onto the recording medium. The pressing member is arranged on the upstream of the transfer unit in the rotating direction, and presses against a rear surface of the endless belt-like image carrier. The recording-medium conveying guide includes upper and lower guide members. The lower guide member is arranged to be in contact with the rear surface of the recording medium when the recording medium is conveyed to the transfer site. As viewed from a direction of shafts of the supporting rollers, the lower guide member has a shape of a triangle with a first side extending toward the endless belt-like image carrier and a second side extending along the endless belt-like image carrier. A boundary point P between the first and second sides of the triangle is set to be located on an extension L1 of a portion of the endless belt-like image carrier between the pressing member and the transfer site or at an arbitrary position shifted on the side of the endless belt-like image carrier from the extension L1. Therefore, it is possible to prevent occurrence of not only a color drift due to bending of the endless belt-like image carrier caused by the recording medium but also a decrease in image quality due to toner dust and the like getting in the space between the endless belt-like image carrier and the recording medium around the transfer site. Furthermore, by the boundary point P (i.e., a vertex of the triangle), the recording medium can be in close contact with the endless belt-like image carrier, whereby it is possible to avoid such a situation that toner dust and the like get in the space between the endless belt-like image carrier and the recording medium.

However, in the technology disclosed in Japanese Patent No. 3813378, when the recording medium is conveyed to the transfer site, a leading end of the recording medium come out from a pair of registration rollers collides directly with the endless belt-like image carrier. Therefore, there is a possibility that the toner image formed on the endless belt-like image carrier is distorted by fluttering of the recording medium due to the collision.

SUMMARY OF THE INVENTION

It is an object of the present invention to at least partially solve the problems in the conventional technology.

According to one aspect of the present invention, there is provided an image forming apparatus of an intermediate transfer type that forms an image by transferring a toner image formed on an image carrier onto a recording medium through an intermediate transfer belt. The image forming apparatus includes a secondary transfer unit that secondary-transfers a toner image formed on the intermediate transfer belt onto the recording medium, which includes a transfer member to which an electrostatic bias is applied, a transfer roller that is pressed by the transfer member across the intermediate transfer belt, and a transfer guide roller that is arranged near the transfer roller on an upstream side thereof in a moving direction of the intermediate transfer belt, and supports the intermediate transfer belt; and a sheet guiding member that is arranged on an upstream side of a transfer nip formed between the transfer member and the transfer roller in a sheet conveying direction on a sheet conveying path on the intermediate transfer belt side. One end of the sheet guiding member on the transfer nip side is located on a straight line connecting an exit of a registration nip formed between a pair of registration rollers and an entrance of the transfer nip or on an opposite side of the intermediate transfer belt across the straight line and on one side of a triangle formed by connecting rotation centers of the transfer member, the transfer roller, and the transfer guide roller or inside the triangle.

Furthermore, according to another aspect of the present invention, there is provided an image forming apparatus of an intermediate transfer type that forms an image by transferring a toner image formed on an image carrier onto a recording medium through an intermediate transfer belt. The image forming apparatus includes a secondary transfer unit that secondary-transfers a toner image formed on the intermediate transfer belt onto the recording medium, which includes a transfer member to which an electrostatic bias is applied, a transfer roller that is pressed by the transfer member across the intermediate transfer belt, and a transfer guide roller that is arranged near the transfer roller on an upstream side thereof in a moving direction of the intermediate transfer belt, and supports the intermediate transfer belt; and a sheet guiding member that is arranged on an upstream side of a transfer nip formed between the transfer member and the transfer roller in a sheet conveying direction on a sheet conveying path on the intermediate transfer belt side. One end of the sheet guiding member on the transfer nip side is located on a straight line connecting an exit of a registration nip formed between a pair of registration rollers and an entrance of the transfer nip or on an opposite side of the intermediate transfer belt across the straight line.

Moreover, according to still another aspect of the present invention, there is provided an image forming apparatus of an intermediate transfer type that forms an image by transferring a toner image formed on an image carrier onto a recording medium through an intermediate transfer belt. The image forming apparatus includes a secondary transfer unit that secondary-transfers a toner image formed on the intermediate transfer belt onto the recording medium, which includes a transfer member to which an electrostatic bias is applied, a transfer roller that is pressed by the transfer member across the intermediate transfer belt, and a transfer guide roller that is arranged near the transfer roller on an upstream side thereof in a moving direction of the intermediate transfer belt, and supports the intermediate transfer belt; and a sheet guiding member that is arranged on an upstream side of a transfer nip formed between the transfer member and the transfer roller in a sheet conveying direction on a sheet conveying path on the intermediate transfer belt side. One end of the sheet guiding member on the transfer nip side is located and on one side of a triangle formed by connecting rotation centers of the transfer member, the transfer roller, and the transfer guide roller or inside the triangle.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention are explained in detail below with reference to the accompanying drawings.

Figure 1:
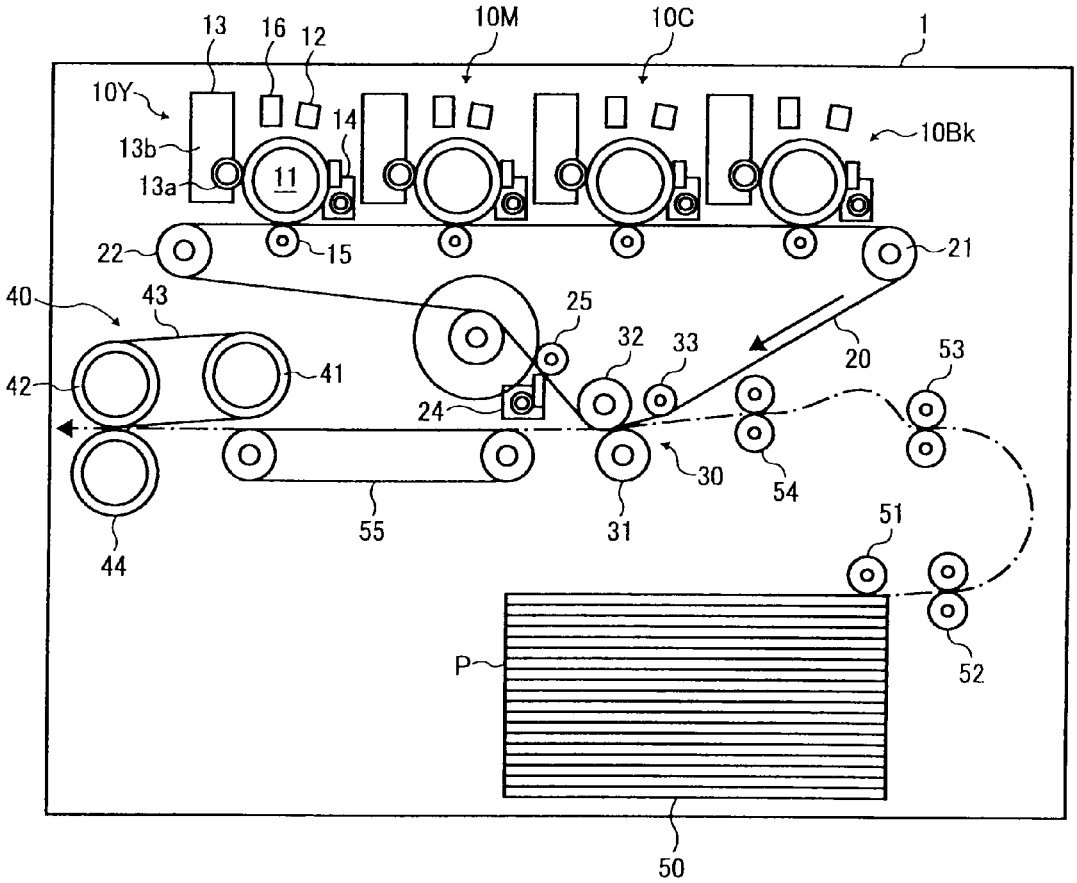
FIG. 1 is a schematic side view of an image forming apparatus according to an embodiment of the present invention.

FIG. 1 is a schematic side view of an image forming apparatus 1 according to an embodiment of the present invention. The image forming apparatus 1 is a tandem-type color image forming apparatus capable of forming a full-color image. The image forming apparatus 1 includes four process units 10 (10Y, 10M, 10C, and 10Bk), an intermediate transfer belt 20, four primary transfer rollers 15, secondary transfer rollers 31 and 32, a pair of registration rollers 54, a conveying belt 55, a fixing unit 40, a sheet feed tray 50, a pick-up roller 51, a pair of separate sheet feed rollers 52, a pair of conveying rollers 53, a drive roller 21, a driven roller 22, a transfer guide roller 33, a belt cleaning unit 24, and a roller 25, and a discharge tray (not shown). The intermediate transfer belt 20 is an endless belt, and will be explained in detail later with reference to FIG. 2. The primary transfer rollers 15 are arranged inside the loop of the intermediate transfer belt 20.

The process units 10Y, 10M, 10C, and 10Bk are arranged in parallel to one another along an upper horizontally-extending portion of the intermediate transfer belt 20. The process units 10Y, 10M, 10C, and 10Bk respectively form yellow (Y), magenta (M), cyan (C), and black (Bk) toner images. The process units 10Y, 10M, 10C, and 10Bk have the same configuration except for a color of toner used therein. For the sake of simplicity, only elements included in the process units 10Y are denoted with reference numerals. Each of the process units 10Y, 10M, 10C, and 10Bk includes a photosensitive drum 11 as an image carrier, a charging unit 12, a developing unit 13, a cleaning unit 14, an exposure unit 16, and a neutralizing unit (not shown). The charging unit 12, the developing unit 13, and the cleaning unit 14 are arranged around the photosensitive drum 11. The photosensitive drums 11 are arranged to be opposed to the primary transfer rollers 15 across the intermediate transfer belt 20. The exposure unit 16 includes a light source such as a light-emitting diode (LED), and is arranged between the charging unit 12 and the developing unit 13. Incidentally, in the present embodiment, the exposure unit 16 is provided to each of the process units 10Y, 10M, 10C, and 10Bk. Alternatively, one exposure device, such as a laser writing device, can be shared by the process units 10Y, 10M, 10C, and 10Bk.

The secondary transfer roller 31 is arranged to be opposed the secondary transfer roller 32 across the intermediate transfer belt 20. The secondary transfer roller 32 is one of supporting rollers that support the intermediate transfer belt 20. The registration rollers 54 are arranged on the right side of the secondary transfer roller 31 in FIG. 1. As shown in FIG. 1, the conveying belt 55 and the registration rollers 54 are arranged on the left and right sides of the secondary transfer roller 31, respectively. The fixing unit 40 is arranged on the left side of the conveying belt 55. The fixing unit 40 is a belt-type fixing unit, and includes a heating roller 41, a fixing roller 42, a fixing belt 43, and a pressure roller 44. The fixing belt 43 is supported by the heating roller 41 and the fixing roller 42. The pressure roller 44 presses against the fixing roller 42 across the fixing belt 43.

The sheet feed tray 50 is arranged at the bottom of the image forming apparatus 1. A stack of sheets P is contained in the sheet feed tray 50. A top sheet P of the stack is picked up by the pick-up roller 51, and fed by the separate sheet feed rollers 52. The sheet P fed by the separate sheet feed rollers 52 is conveyed along a sheet conveying path as indicated by a dashed-dotted line in FIG. 1. The conveying rollers 53 and a sheet guide (not shown) are respectively provided at an arbitrary position on the sheet conveying path.

As needed basis, a manual sheet feed unit and a sheet reversing unit can be installed in the image forming apparatus 1. Furthermore, an image reading device such as a scanner and an automatic document feeder (ADF) can be also installed in the image forming apparatus 1.

An image forming process performed by the image forming apparatus 1 is briefly explained below.

The photosensitive drum 11 is driven to rotate in a counterclockwise direction in FIG. 1 by a drive unit (not shown). The surface of the photosensitive drum 11 is uniformly charged at a voltage of a predetermined polarity by the charging unit 12. The uniformly-charged surface of the photosensitive drum 11 is exposed to a light emitted from the exposure unit 16, whereby an electrostatic latent image is formed on the surface of the photosensitive drum 11. Incidentally, the exposure units 16 included in the process units 10Y, 10M, 10C, and 10Bk respectively emit lights corresponding to Y, M, C, and Bk image data that desired full-color image data is separated thereinto. The electrostatic latent image is developed into a toner image in corresponding color by the developing unit 13.

The intermediate transfer belt 20 is driven to move in a clockwise direction in FIG. 1. As the intermediate transfer belt 20 passes through primary nip portions formed between the photosensitive drums 11 and the primary transfer rollers 15, the Y, M, C, and Bk toner images formed on the photosensitive drums 11 are sequentially transferred onto the intermediate transfer belt 20 in a superimposed manner, whereby a full-color toner image is formed on the surface of the intermediate transfer belt 20.

Incidentally, it is possible to form a single-color toner image by the use of any one of the process units 10Y, 10M, 10C, and 10Bk. Furthermore, it is also possible to form a two-color or three-color toner image by the use of any two or three of the process units 10Y, 10M, 10C, and 10Bk. For example, when a monochromatic (black-and-white) image is formed, only the process unit 10Bk on the extreme right in FIG. 1 is used.

After the toner image is transferred onto the intermediate transfer belt 20, residual toner remaining on the surface of the photosensitive drum 11 is removed by the cleaning unit 14. After that, the neutralizing unit neutralizes a surface potential of the photosensitive drum 11 so as to prepare for a next image forming process.

On the other hand, the sheet P fed from the sheet feed tray 50 is conveyed to the registration rollers 54. The sheet P is conveyed to a secondary-transfer nip formed between the secondary transfer rollers 31 and 32 by the registration rollers 54 in synchronization with a timing at which the full-color toner image formed on the intermediate transfer belt 20 comes to the secondary-transfer nip. While the sheet P passes through the secondary-transfer nip, the full-color toner image formed on the surface of the intermediate transfer belt 20 is transferred onto the sheet P, whereby a full-color image is formed on the sheet P. Then, the sheet P is conveyed to the fixing unit 40. In the fixing unit 40, by the application of heat and pressure, the full-color image is fused and fixed on the sheet P. The sheet P on which the full-color image is formed is discharged onto the discharge tray.

Figure 2:
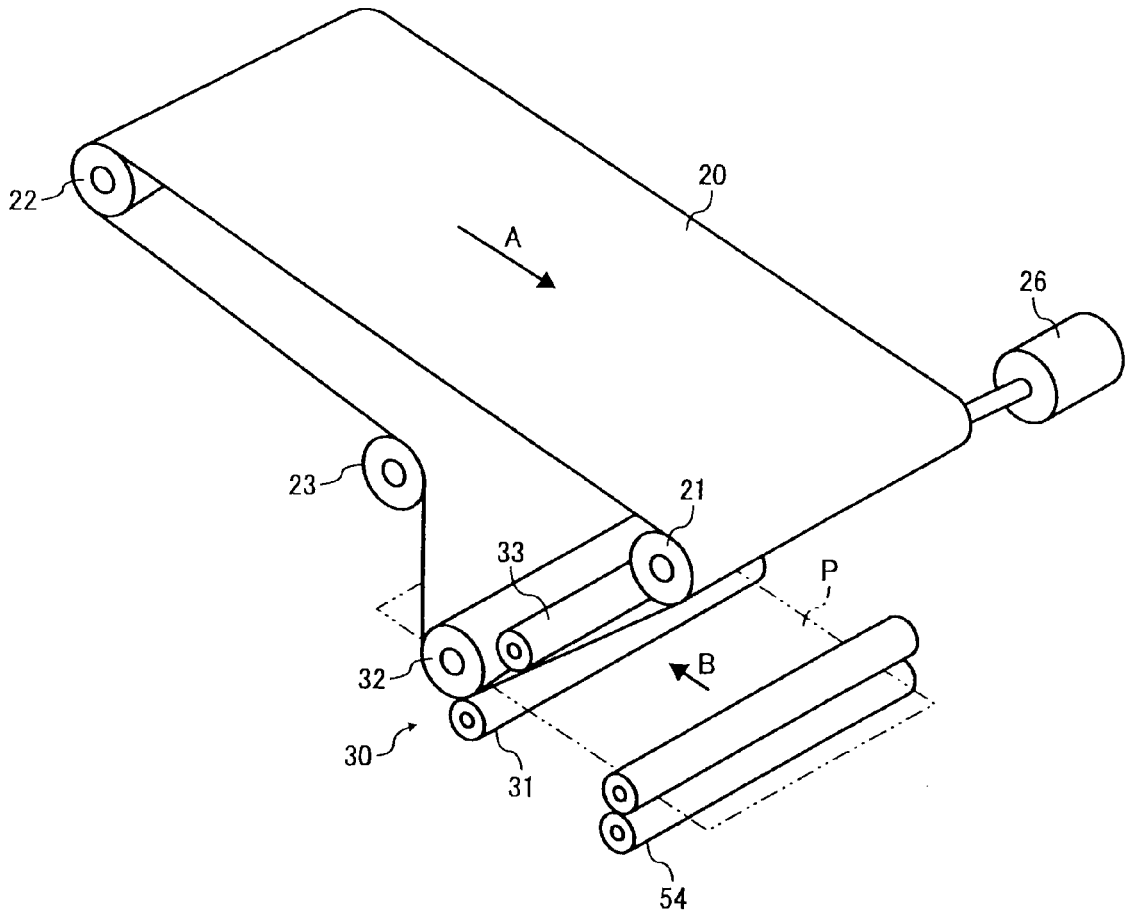
FIG. 2 is an enlarged perspective view of an intermediate transfer belt shown in FIG. 1 and supporting rollers thereof.

FIG. 2 is an enlarged perspective view of the intermediate transfer belt 20 and the supporting rollers thereof.

As shown in FIG. 2, the intermediate transfer belt 20 is supported by the drive roller 21, the driven roller 22, an outer supporting roller 23, the secondary transfer roller 32, and the transfer guide roller 33. When the drive roller 21 is driven to rotate by a motor 26, the intermediate transfer belt 20 moves in a direction of an arrow A in accordance with the rotation of the drive roller 21. A load applying unit (not shown) causes the driven roller 22 to apply a tension to the intermediate transfer belt 20. By the application of the tension, a frictional conveying force is generated between the drive roller 21 and the intermediate transfer belt 20.

As shown in FIG. 1, the photosensitive drums 11 are arranged on the upper horizontally-extending portion of the intermediate transfer belt 20 that is formed by being tensed by the drive roller 21 and the driven roller 22. The primary transfer rollers 15 are arranged inside the loop of the intermediate transfer belt 20 so as to be opposed to the photosensitive drums 11 across the intermediate transfer belt 20.

The secondary transfer roller 31 is arranged below the secondary transfer roller 32, and presses against the secondary transfer roller 32 across the intermediate transfer belt 20. A predetermined high voltage is applied to the secondary transfer roller 31 by a transfer power supply (not shown), whereby an electrostatic transfer bias is applied to the secondary-transfer nip between the secondary transfer rollers 31 and 32. When the sheet P is conveyed to the secondary-transfer nip, the secondary transfer roller 31 conveys the sheet P by holding the sheet P together with the secondary transfer roller 32 and the intermediate transfer belt 20 with the use of a predetermined pressing force. The transfer guide roller 33 is arranged inside the loop of the intermediate transfer belt 20 and the upstream side of the secondary transfer roller 32 in a moving direction of the intermediate transfer belt 20. A secondary transfer unit 30 is composed of the secondary transfer rollers 31 and 32 and the transfer guide roller 33. Incidentally, as shown in FIG. 1, the transfer guide roller 33 is arranged on the slightly outside of a straight line connecting outer circumferential surfaces of the secondary transfer rollers 31 and 32, and presses the intermediate transfer belt 20 from the inside to the outside.

Although it is not illustrated in FIG. 2, the belt cleaning unit 24 (see FIG. 1) is arranged outside the loop of the intermediate transfer belt 20, and located between the secondary transfer roller 32 and the outer supporting roller 23. The belt cleaning unit 24 includes a cleaning blade, and cleans the intermediate transfer belt 20 with the cleaning blade. The roller 25 (see FIG. 1) is arranged inside the loop of the intermediate transfer belt 20 so as to be opposed to the cleaning blade across the intermediate transfer belt 20.

After an orientation of the sheet P is corrected by the registration rollers 54, the sheet P is conveyed in a direction of an arrow B shown in FIG. 2 by the registration rollers 54. While the sheet P passes through the secondary-transfer nip between the secondary transfer rollers 31 and 32, the toner image formed transferred onto the intermediate transfer belt 20 is electrostatically transferred onto the sheet P.

Figure 3:
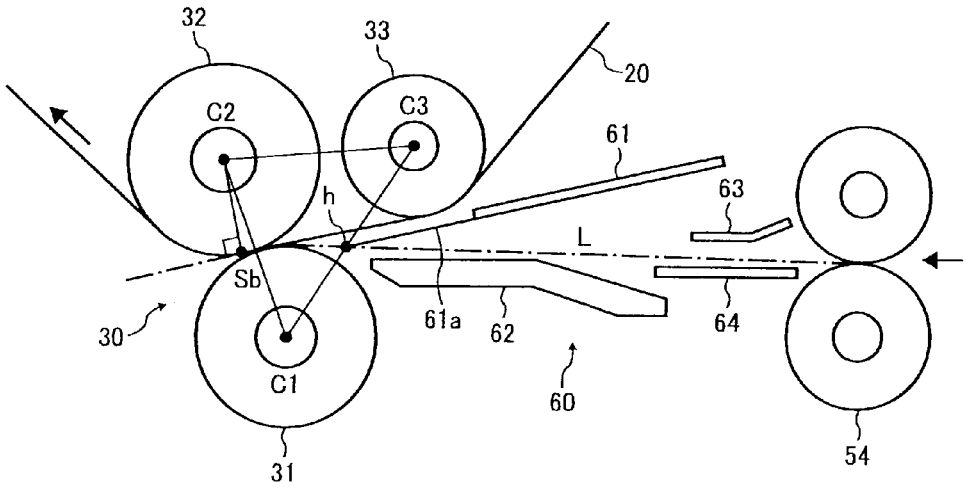
FIG. 3 is an enlarged side view for explaining a sheet guiding unit included in the image forming apparatus according to the embodiment.

FIG. 3 is an enlarged side view for explaining a sheet guiding unit 60.

In the present embodiment, as described above, the secondary transfer unit 30 is composed of the secondary transfer rollers 31 and 32 and the transfer guide roller 33. As shown in FIG. 3, the registration rollers 54 are arranged on the upstream of the secondary transfer unit 30 in a sheet conveying direction. The registration rollers 54 convey the sheet P in the direction of the arrow B (see FIG. 2) by holding the sheet P between of which with the use of a predetermined pressing force. The sheet guiding unit 60 is provided between the registration rollers 54 and the secondary transfer unit 30. The sheet guiding unit 60 guides the sheet P come out from the registration rollers 54 to be conveyed to the secondary-transfer nip.

As shown in FIG. 3, the sheet guiding unit 60 includes first upper and lower guide members 61 and 62 and second upper and lower guide members 63 and 64. The first upper guide member 61 is located near the intermediate transfer belt 20. A first end (as indicated by "h" in FIG. 3) of the first upper guide member 61 on the side of the secondary-transfer nip is located on a straight line L connecting an exit of a nip formed between the registration rollers 54 (hereinafter, "a registration nip exit") and an entrance of the secondary-transfer nip (hereinafter, "a transfer nip entrance").

By such a configuration, a leading end of the sheet P come out from the registration rollers 54 is controlled to head into the secondary transfer roller 31. Therefore, it is possible to prevent the leading end of the sheet P from colliding directly with the intermediate transfer belt 20. Thus, it is possible to prevent the toner image transferred onto the intermediate transfer belt 20 from being distorted by fluttering of the sheet P due to the collision. Consequently, it is possible to achieve the stable transfer of the toner image, and thus it is possible to form a high-quality image without any distortion.

Incidentally, to increase the effect of controlling the sheet P not to collide directly with the intermediate transfer belt 20, the position of the first end of the first upper guide member 61 located on the straight line L can be shifted on the side of the secondary transfer roller 31 (on the opposite side of the intermediate transfer belt 20). However, in this case, the sheet conveying path is curved, so that it is preferable not to shift the position of the first end of the first upper guide member 61 too far (i.e., significantly downward) from the straight line L.

Furthermore, in the present embodiment, the position of the first end of the first upper guide member 61 is set to be located on one side C1-C3 of a triangle formed by connecting a rotation center C1 of the secondary transfer roller 31, a rotation center C2 of the secondary transfer roller 32, and a rotation center C3 of the transfer guide roller 33 (or inside the triangle). Therefore, when the leading end of the sheet P is held between the secondary transfer rollers 31 and 32 (i.e., in the secondary-transfer nip) while a posterior portion of the sheet P is being coming out from the registration rollers 54, although the sheet P tends to bend due to the difference in peripheral speed between the registration rollers 54 and the secondary transfer roller 31, the first upper guide member 61 prevents the leading end of the sheet P from coming in contact with the intermediate transfer belt 20. Thus, it is possible to prevent the toner image transferred onto the intermediate transfer belt 20 from being distorted by the sheet P. Consequently, it is possible to achieve the stable transfer of the toner image, and thus it is possible to form a high-quality image without any distortion.

Incidentally, to increase the effect of controlling the sheet P not to bend, the position of the first end of the first upper guide member 61 can be shifted inside the triangle. However, in this case, the first end of the first upper guide member 61 comes close to the intermediate transfer belt 20 and the secondary transfer roller 31, so that the first end of the first upper guide member 61 may have contact with the intermediate transfer belt 20 or the secondary transfer roller 31. Therefore, it is preferable not to shift the position of the first end of the first upper guide member 61 too far from the side C1-C3 of the triangle.

Moreover, in the present embodiment, the secondary transfer roller 31 is electrically-grounded, and the rotation center C1 of which is located on the upstream of a perpendicular C2-Sb from the rotation center C2 of the secondary transfer roller 32 to a lower extending portion of the intermediate transfer belt 20 that is formed by being tensed by the secondary transfer roller 32 and the transfer guide roller 33 in the sheet conveying direction. Therefore, a predetermined pressing force is applied to the sheet P and the intermediate transfer belt 20 by the secondary transfer roller 31, whereby the sheet P can be conveyed while being in contact with the intermediate transfer belt 20 stably. After that, the sheet P is nipped in the secondary-transfer nip (between the secondary transfer rollers 31 and 32) to which the transfer bias is applied. Therefore, it is possible to prevent image defect caused by an electric discharge generated in a narrow gap, and also possible to prevent the toner image transferred onto the intermediate transfer belt 20 from being distorted. Consequently, it is possible to achieve the stable transfer of the toner image, and thus it is possible to form a high-quality image without any distortion.

Furthermore, in the present embodiment, a portion 61*a* of the first upper guide member 61 on the side of the first end is made of a flexible member. Alternatively, a separate flexible member can be attached to the stiff first upper guide member 61. Therefore, even if the leading end of the sheet P collides with the first upper guide member 61, or the bent sheet P presses the first upper guide member 61, the flexible portion 61*a* suppresses the sheet P from bouncing back. Thus, it is possible to achieve the stable conveyance of the sheet P. The flexible member used in the portion 61*a* has the adequate flexibility enough to achieve the sheet controllability.

Figure 4:
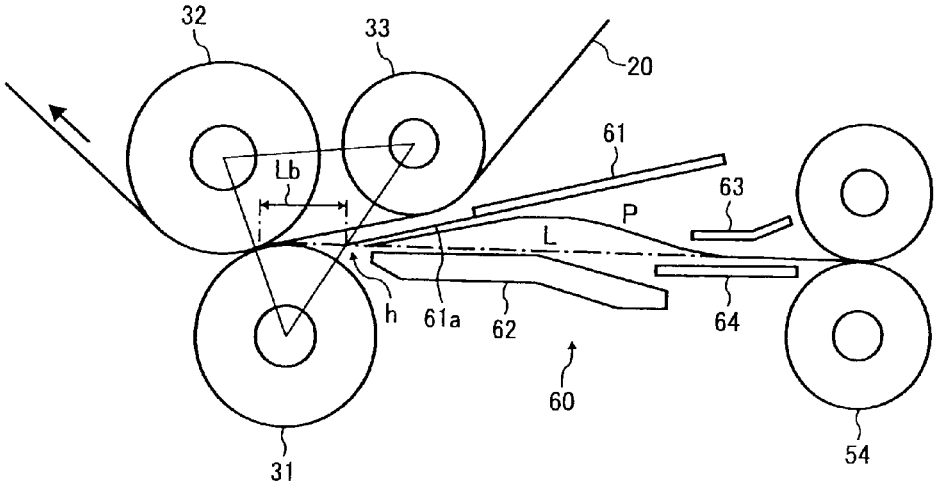
FIG. 4 is an enlarged side view for explaining a state where a sheet bends due to a difference in peripheral speed between registration rollers and a secondary transfer roller.

FIG. 4 shows a state where the sheet P bends due to the difference in peripheral speed between the registration rollers 54 and the secondary transfer roller 31. At this time, the leading end of the sheet P is held in the secondary-transfer nip while a posterior portion of the sheet P is being coming out from the registration rollers 54.

In general, the peripheral speed of the registration roller is set to be higher than that of the transfer roller by a small percent. Therefore, when the leading end of the sheet P is held in the secondary-transfer nip while the posterior portion of the sheet P is being coming out from the registration rollers 54, the sheet P bends in an area between the secondary transfer unit 30 and the registration rollers 54.

In the present embodiment, as described above, the sheet guiding unit 60 including the first upper and lower guide members 61 and 62 and the second upper and lower guide members 63 and 64 is provided in the area. Furthermore, it is configured that the position of the first end of the first upper guide member 61 is located on the straight line L connecting the registration nip exit and the transfer nip entrance and also located on the side C1-C3 of the triangle formed by connecting the rotation centers C1, C2, and C3 of the secondary transfer roller 31, the secondary transfer roller 32, and the transfer guide roller 33.

By this configuration, a distance "Lb" between the secondary-transfer nip and the first end of the first upper guide member 61 is reduced, i.e., a portion of the sheet P controlled not to bend by the first upper guide member 61 is shortened. Therefore, the rigidity in bending of the sheet P is increased, and also deformation of the sheet P to the side of the secondary transfer roller 32 is suppressed. As a result, the sheet P can be prevented from bending in the area between the secondary-transfer nip and the first end of the first upper guide member 61. Thus, a possibility that the sheet P comes in contact with the intermediate transfer belt 20 can be reduced.

In this manner, the bending of sheet P to the side of the intermediate transfer belt 20 is prevented. That is, the sheet P is prevented from coming in contact with the intermediate transfer belt 20. Therefore, it is possible to prevent the toner image transferred onto the intermediate transfer belt 20 from being distorted by the sheet P. Consequently, it is possible to achieve the stable transfer of the toner image, and thus it is possible to form a high-quality image without any distortion.

Figure 5:
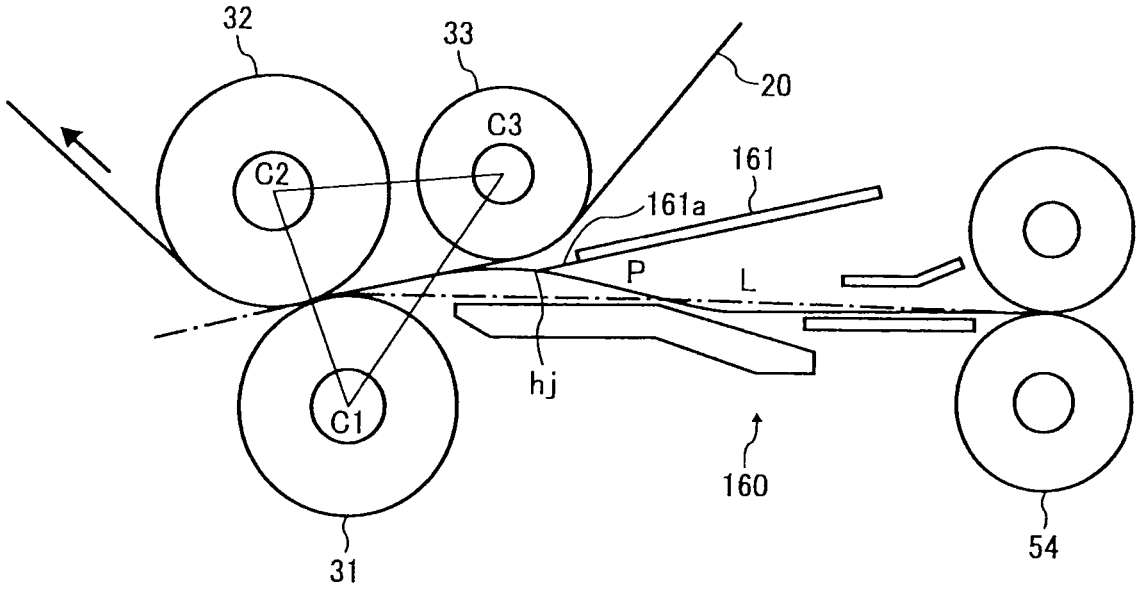
FIG. 5 is an enlarged side view for explaining an example of a sheet guiding unit included in a conventional image forming apparatus.

FIG. 5 is an enlarged side view for explaining an example of a sheet guiding unit 160 included in a conventional image forming apparatus. A difference between the sheet guiding unit 160 and the sheet guiding unit 60 is that the sheet guiding unit 160 includes a first upper guide member 161 instead of the first upper guide member 61. The portions identical to those in FIG. 4 are denoted with the same reference numerals, and the description of those portions is omitted. When a leading end of a sheet P is held between the secondary transfer rollers 31 and 32 (i.e., in the secondary-transfer nip) while a posterior portion of the sheet P is being coming out from the registration rollers 54, the sheet P bends due to the difference in peripheral speed between the registration rollers 54 and the secondary transfer roller 31.

In this example, the position of a first end (as indicated by "hj" in FIG. 5) of the first upper guide member 161 on the side of the secondary-transfer nip is located on the side of the secondary transfer roller 32 rather than the straight line L connecting the registration nip exit and the transfer nip entrance and also located outside the triangle formed by connecting the rotation centers C1, C2, and C3 of the secondary transfer roller 31, the secondary transfer roller 32, and the transfer guide roller 33.

In other words, the first upper guide member 161 does not serve to sufficiently prevent the bending of sheet P to the side of the secondary transfer roller 32. Furthermore, a distance between the secondary-transfer nip and the first end of the first upper guide member 161 is relatively long, i.e., a portion of the sheet P controlled not to bend by the first upper guide member 161 is lengthened. Therefore, the rigidity in bending of the sheet P is decreased while passing through a portion between the secondary-transfer nip and the first end of the first upper guide member 161. As a result, due to the difference in peripheral speed between the registration rollers 54 and the secondary transfer roller 31, the sheet P bends at the portion between the secondary-transfer nip and the first end of the first upper guide member 161. Thus, the bent sheet P may come in contact with the intermediate transfer belt 20. At this time, the sheet P is not completely nipped in the secondary-transfer nip, i.e., the sheet P is not in close contact with the intermediate transfer belt 20. Therefore, when the bent sheet P comes in contact with the intermediate transfer belt 20, the toner image transferred onto the intermediate transfer belt 20 is distorted by the sheet P.

However, in the present embodiment, the leading end of the sheet P come out from the registration rollers 54 is controlled to head into the secondary transfer roller 31. Therefore, it is possible to prevent the leading end of the sheet P from colliding directly with the intermediate transfer belt 20. Thus, it is possible to prevent the toner image transferred onto the intermediate transfer belt 20 from being distorted by fluttering of the sheet P due to the collision. Consequently, it is possible to achieve the stable transfer of the toner image, and thus it is possible to form a high-quality image without any distortion.

Furthermore, in the present embodiment, when the leading end of the sheet P is nipped in the secondary-transfer nip while a posterior portion of the sheet P is being coming out from the registration rollers 54, although the sheet P tends to bend upward, i.e., toward the intermediate transfer belt 20 due to the difference in peripheral speed between the registration rollers 54 and the secondary transfer roller 31, the first upper guide member 61 prevents the sheet P from coming in contact with the intermediate transfer belt 20. Thus, it is possible to prevent the toner image transferred onto the intermediate transfer belt 20 from being distorted by the sheet P. Consequently, it is possible to achieve the stable transfer of the toner image, and thus it is possible to form a high-quality image without any distortion.

Moreover, in the present embodiment, it is possible to prevent the leading end of the sheet P from colliding directly with the intermediate transfer belt 20 and to prevent the bent sheet P from being in contact with the intermediate transfer belt 20 simultaneously. Thus, it is possible to prevent the toner image transferred onto the intermediate transfer belt 20 from being distorted by the sheet P, and also to achieve the stable transfer of the toner image thereby forming a high-quality image without any distortion.

Furthermore, in the present embodiment, the portion 61a of the first upper guide member 61 is made of the flexible member. Therefore, even if the leading end of the sheet P collides with the first upper guide member 61, or the bent sheet P presses the first upper guide member 61, the flexible portion 61*a* suppresses the sheet P from bouncing back. Thus, it is possible to achieve the stable conveyance of the sheet P.

The exemplary embodiment of the present invention is explained above. However, the present invention is not limited to the embodiment. For example, in the above embodiment, it is configured that the position of the first end of the first upper guide member 61 is located on the straight line L connecting the registration nip exit and the transfer nip entrance and also located on the side C1-C3 of the triangle formed by connecting the rotation centers C1, C2, and C3 of the secondary transfer roller 31, the secondary transfer roller 32, and the transfer guide roller 33 or slightly inside the triangle. Alternatively, the first upper guide member 61 can be configured to meet any of the above two conditions.

Furthermore, in the above embodiment, the transfer rollers are used as the transfer unit. Alternatively, a belt-like transfer means (hereinafter, "a transfer belt") can be used as the transfer unit. In this case, out of supporting rollers that support the transfer belt, a rotation center of the supporting roller that is pressed by the supporting roller corresponding to the secondary transfer roller 32 is set as one vertex of the triangle.

Moreover, a configuration of the units included in the image forming apparatus 1 can be arbitrarily changed. The order of the process units 10Y, 10M, 10C, and 10Bk is not limited to that is shown in FIG. 1. Furthermore, the image forming apparatus according to the present invention is not limited to the tandem-type image forming apparatus. For example, the present invention can be applied to the one in which a plurality of developing units is arranged around one photosensitive element or the one employing a revolver-type developing unit. In addition, the present invention can be applied to a color image forming apparatus using two or three toners. The image forming apparatus according to the present invention includes, but is not limited to, a printer, a copier, a facsimile machine, and a digital multifunction product (MFP).

According to one aspect of the present invention, it is possible to provide an image forming apparatus capable of preventing a toner image transferred onto an intermediate transfer belt from being distorted by a sheet. Therefore, it is possible to achieve the stable transfer of the toner image, and thus the image forming apparatus according to the present invention can form a high-quality image without any distortion.

Furthermore, according to another aspect of the present invention, a leading end of the sheet come out from a pair of registration rollers is controlled to head into a transfer member. Therefore, it is possible to prevent the leading end of the sheet from colliding directly with the intermediate transfer belt. Thus, it is possible to prevent the toner image transferred onto the intermediate transfer belt from being distorted by fluttering of the sheet due to the collision. Consequently, it is possible to achieve the stable transfer of the toner image, and thus the image forming apparatus according to the present invention can form a high-quality image without any distortion.

Moreover, according to still another aspect of the present invention, when the leading end of the sheet is held between the transfer member and a transfer roller while a posterior portion of the sheet is being coming out from the registration rollers, although the sheet tends to bend toward the intermediate transfer belt due to the difference in peripheral speed between the registration rollers and the transfer member, it is configured to prevent the sheet from coming in contact with the intermediate transfer belt. Thus, it is possible to prevent the toner image transferred onto the intermediate transfer belt from being distorted by the sheet. Consequently, it is possible to achieve the stable transfer of the toner image, and thus the image forming apparatus according to the present invention can form a high-quality image without any distortion.

Furthermore, according to still another aspect of the present invention, just before the leading end of the sheet is nipped in a transfer nip formed between the transfer member and a transfer roller, the sheet is conveyed in a state where the sheet is in close contact with the intermediate transfer belt because a predetermined pressing force is applied to the sheet and the intermediate transfer belt by the transfer member. Therefore, it is possible to prevent image defect caused by an electric discharge generated in a narrow gap, and also possible to prevent the toner image transferred onto the intermediate transfer belt from being distorted. Consequently, it is possible to achieve the stable transfer of the toner image, and thus the image forming apparatus according to the present invention can form a high-quality image without any distortion.

Moreover, according to still another aspect of the present invention, even if the leading end of the sheet collides with a sheet guiding member, or the bent sheet presses the sheet guiding member, a flexible portion of the sheet guiding member suppresses the sheet from bouncing back. Thus, it is possible to achieve the stable conveyance of the sheet.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus of an intermediate transfer type that forms an image by transferring a toner image formed on an image carrier onto a recording medium through an intermediate transfer belt, the image forming apparatus comprising:

a secondary transfer unit that secondary-transfers a toner image formed on the intermediate transfer belt onto the recording medium, the secondary transfer unit including a transfer member to which an electrostatic bias is applied, a transfer roller that is pressed by the transfer member across the intermediate transfer belt, and a transfer guide roller that is arranged near the transfer roller on an upstream side thereof in a moving direction of the intermediate transfer belt, and supports the intermediate transfer belt; and a sheet guiding member that is arranged on an upstream side of a transfer nip formed between the transfer member and the transfer roller in a sheet conveying direction on a sheet conveying path on the intermediate transfer belt side, wherein one end of the sheet guiding member on the transfer nip side is located on a straight line connecting an exit of a registration nip formed between a pair of registration rollers and an entrance of the transfer nip or inside of a triangle formed by connecting rotation centers of the transfer member, the transfer roller, and the transfer guide roller.

2. The image forming apparatus according to claim 1, wherein the transfer member is electrically-grounded, and the rotation center of the transfer member is located on a side of the entrance of the transfer nip rather than a perpendicular from the rotation center of the transfer roller to a lower extending portion of the intermediate transfer belt that is formed by being supported by the transfer roller and the transfer guide roller.

3. The image forming apparatus according to claim 1, wherein an end portion of the sheet guiding member on the side of the transfer nip is made of a flexible member.

4. The image forming apparatus of claim 1, further comprising:

a pair of guide members located closer to the pair of registration rollers than the sheet guiding member.

5. The image forming apparatus of claim 1, wherein all portions of the sheet guiding member except for the one end are above the line connecting the exit of the registration nip and the entrance of the transfer nip.

6. An image forming apparatus of an intermediate transfer type that forms an image by transferring a toner image formed on an image carrier onto a recording medium through an intermediate transfer belt, the image forming apparatus comprising:

a secondary transfer unit that secondary-transfers a toner image formed on the intermediate transfer belt onto the recording medium, the secondary transfer unit including a transfer member to which an electrostatic bias is applied, a transfer roller that is pressed by the transfer member across the intermediate transfer belt, and a transfer guide roller that is arranged near the transfer roller on an upstream side thereof in a moving direction of the intermediate transfer belt, and supports the intermediate transfer belt; and a sheet guiding member that is arranged on an upstream side of a transfer nip formed between the transfer member and the transfer roller in a sheet conveying direction on a sheet conveying path on the intermediate transfer belt side, wherein one end of the sheet guiding member on the transfer nip side is located on a straight line connecting an exit of a registration nip formed between a pair of registration rollers and an entrance of the transfer nip.

7. The image forming apparatus according to claim 6, wherein the transfer member is electrically-grounded, and the rotation center of the transfer member is located on a side of the entrance of the transfer nip rather than a perpendicular from the rotation center of the transfer roller to a lower extending portion of the intermediate transfer belt that is formed by being supported by the transfer roller and the transfer guide roller.

8. The image forming apparatus according to claim 6, wherein an end portion of the sheet guiding member on the side of the transfer nip is made of a flexible member.

9. An image forming apparatus of an intermediate transfer type that forms an image by transferring a toner image formed on an image carrier onto a recording medium through an intermediate transfer belt, the image forming apparatus comprising:

a secondary transfer unit that secondary-transfers a toner image formed on the intermediate transfer belt onto the recording medium, the secondary transfer unit including a transfer member to which an electrostatic bias is applied, a transfer roller that is pressed by the transfer member across the intermediate transfer belt, and a transfer guide roller that is arranged near the transfer roller on an upstream side thereof in a moving direction of the intermediate transfer belt, and supports the intermediate transfer belt; and a sheet guiding member that is arranged on an upstream side of a transfer nip formed between the transfer member and the transfer roller in a sheet conveying direction on a sheet conveying path on the intermediate transfer belt side, wherein one end of the sheet guiding member on the transfer nip side is located inside of a triangle formed by connecting rotation centers of the transfer member, the transfer roller, and the transfer guide roller.

10. The image forming apparatus according to claim 9, wherein the transfer member is electrically-grounded, and the rotation center of the transfer member is located on a side of the entrance of the transfer nip rather than a perpendicular from the rotation center of the transfer roller to a lower extending portion of the intermediate transfer belt that is formed by being supported by the transfer roller and the transfer guide roller.

11. The image forming apparatus according to claim 9, wherein an end portion of the sheet guiding member on the side of the transfer nip is made of a flexible member.

* * * * *